US005342016A

United States Patent [19]

Marsault et al.

[11] Patent Number: 5,342,016

[45] Date of Patent: Aug. 30, 1994

[54] DEVICE FOR SUPPORTING, ON A FIXED FRAMEWORK, A MASS WHICH IS CANTILEVERED OUT FROM A MOVING ELEMENT

[75] Inventors: Jean-Jacques Marsault, Bures-sur-Yvette; Michel Barbotte, Palaiseau; Jean-Pierre Baudel, Asnieres, all of France

[73] Assignee: Stein Industrie, Velizy-Villacoublay, France

[21] Appl. No.: 995,158

[22] Filed: Dec. 22, 1992

[30] Foreign Application Priority Data

Dec. 23, 1991 [FR] France ..... 91 16027

[51] Int. Cl.[5] ..... F16M 13/00

[52] U.S. Cl. ..... 248/610; 248/901

[58] Field of Search ..... 248/610, 901; 122/510; 165/81, 162

[56] References Cited

U.S. PATENT DOCUMENTS

| | | | |
|---|---|---|---|
| 4,023,756 | 5/1977 | Baker | 248/901 X |
| 4,137,967 | 2/1979 | Hirschle | 122/510 |
| 4,190,104 | 2/1980 | Frei | 165/162 |
| 4,516,750 | 5/1985 | Brunner | 248/901 X |
| 4,972,806 | 11/1990 | Marsault | 248/901 X |
| 5,042,452 | 8/1991 | Dubreuil et al. | 165/162 X |

FOREIGN PATENT DOCUMENTS

| | | | |
|---|---|---|---|
| 2640356 | 6/1990 | France . | |
| 0499448 | 1/1976 | U.S.S.R. | 248/901 |

*Primary Examiner*—Ramon O. Ramirez

*Attorney, Agent, or Firm*—Sughrue, Mion, Zinn, Macpeak & Seas

[57] ABSTRACT

A support device for supporting on a stationary framework a mass which is cantilevered-out from a moving element that moves under the effect of thermal expansion or contraction. The device comprises a rigid stand supporting the mass and connected to the stationary framework via two parallel arms of equal length and situated at two different heights, each of the two arms being hinged at one of its ends to a corresponding point on the stand and at its other end to a corresponding point on the stationary framework, the rigid support being placed on the moving elements via a connection that slides horizontally. The device is applicable to supporting collector manifolds in steam generators or boilers.

4 Claims, 1 Drawing Sheet

DEVICE FOR SUPPORTING, ON A FIXED FRAMEWORK, A MASS WHICH IS CANTILEVERED OUT FROM A MOVING ELEMENT

The present invention relates to a device for supporting, on a fixed framework, a mass which is cantilevered out from an element that moves under the effect of temperature expansion or contraction.

BACKGROUND OF THE INVENTION

Devices of this kind are used in particular in steam generators or boilers in which the problem often arises of suspending masses (such as collector manifolds) on the walls of combustion chambers in which the tubes for conveying a flow of water to be boiled are subjected to large expansions and contractions as a function of the temperature of the fluid flowing therein. These manifolds are placed in a cantilevered-out position relative to the wall constituted by the tubes, and it is essential for them to follow the displacements of the wall without transmitting forces to the wall that could deform it.

Proposals have already been made to suspend such manifolds from spring supports which are designed to take up a fraction of the weight of the cantilevered-out mass, while nevertheless being capable of following the displacements of the mass without excessive variation in the force they provide. However, such springs act only as counterweights, and they control the vertical position of the mass only at the cost of parasitic forces on the walls of the combustion chamber, which forces are all the greater since the force to be taken up by the spring is not constant, depending, as it does, on forces of varying magnitude applied by the pipework connected to the manifolds. Furthermore, the manifolds do not remain completely stationary relative to the wall of the combustion chamber.

Proposals have also been made to support such collector manifolds by vertical carrier tubes conveying a fluid which causes them to expand thermally by an amount equal to the expansion of the wall of the steam generator. The manifolds are then indeed stationary relative to the wall of the combustion chamber. However, such devices are complex and expensive, and their operation can be disturbed either because of a delay in the thermal expansion of the vertical carrier tubes relative to that of the wall of the combustion chamber, or else because of poor circulation of the fluid in the carrier tubes. As a result, equal thermal expansion no longer occurs in the vertical carrier tubes and the wall of the combustion chamber, and this can lead to unacceptable stresses appearing in the wall.

Proposals have also been made in document FR-A-2 269 023 to take up the cantilevered weight of manifolds or burners in combustion chambers by means of lever systems having pivot points secured to a stationary framework and disposed in such a manner that the displacements of the support point for the manifold or the burner are equal to the displacements of the connection point on the wall of the combustion chamber. However, the levers in those systems are subjected to bending, and their total accumulated bending deformation degrades overall stiffness, unless they are themselves overdimensioned.

Finally, document FR-A-2 640 356 proposes a support device comprising firstly a hinged plane support on which the cantilevered-out mass is placed, and secondly a system of three hinged arms connecting the fixed framework to the moving element and the plane support.

The various components of that device are not subjected to bending stresses, but only to stresses in traction or compression.

However, that device is relatively complicated since it requires three hinged arms.

An object of the present invention is to provide a rigid support device for such cantilevered-out masses, which is simpler while having displacements that follow more accurately the displacements of the vertically movable element.

SUMMARY OF THE INVENTION

The device of the invention comprises a rigid stand supporting the mass and connected to the stationary framework via two parallel arms of equal length and situated at two different heights, each of the two arms being hinged at one of its ends to a corresponding point on the stand and at its other end to a corresponding point on the stationary framework, the rigid support being placed on the moving elements via a connection that slides horizontally.

It preferably satisfies one or other of the following features:

the mass is slidably placed on the rigid stand; and the points where the hinged arms are hinged to the stationary framework are not situated at the same height as the points where the same arms are hinged to the rigid stand.

In each of its variants, the device may also include a support for the mass which exerts a constant upwards traction force on the stand.

BRIEF DESCRIPTION OF THE DRAWING

Embodiment of the invention are described by way of example with reference to the accompanying drawing, in which.

DETAILED DESCRIPTION

The following description made with reference to the figures of the accompanying drawing concerns devices of the invention for supporting a steam collector manifold on a fixed framework, which manifold is connected in a cantilevered-out position to the screen made up of pipework for conveying a flow of water to be boiled along the walls of a combustion chamber in a steam generator or boiler.

Figure 1:
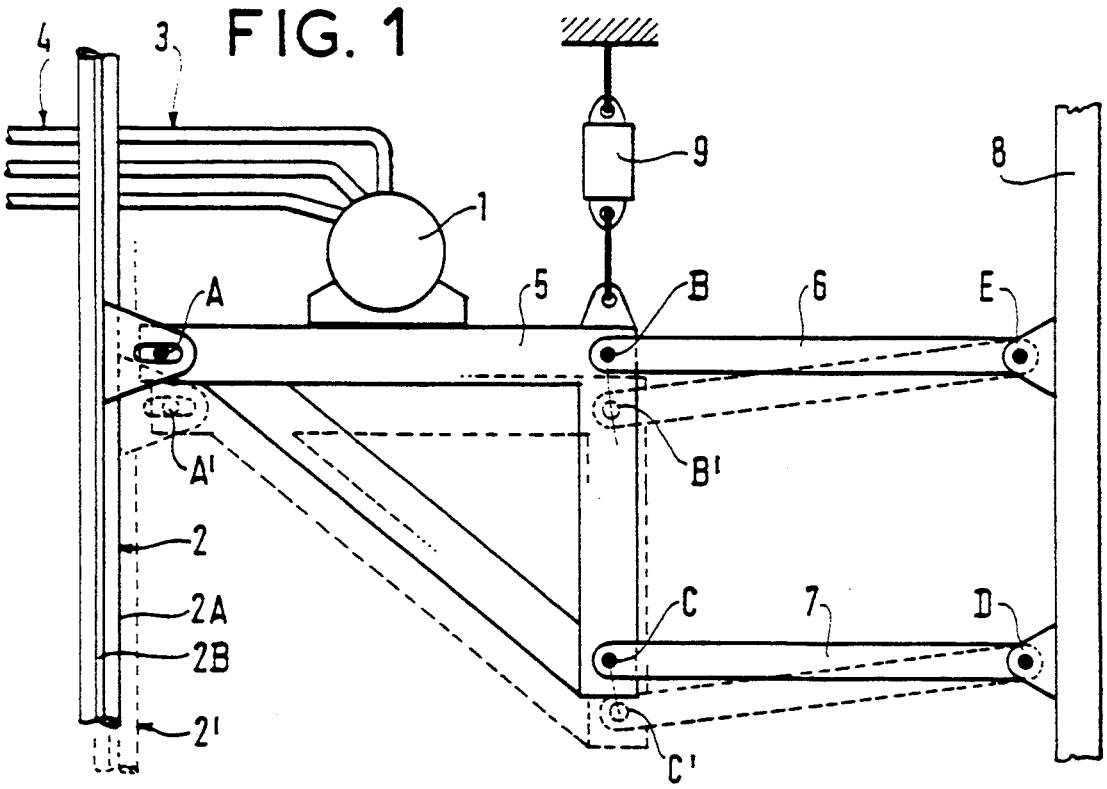
FIG. 1 is a diagrammatic elevation view of a first embodiment of the device of the invention in which the two arms remain substantially horizontal.

In FIG. 1, the steam collector manifold 1 is fixed relative to a partition 2 made up of tubes 2*a* and connecting fins 2*b* disposed in a combustion chamber of a boiler. The manifold is fixed in such a manner that its link tubes 3 connecting with superheater tubes 4 are not subjected to stresses due to differential vertical displacements between the manifold and the partition.

The manifold is fixed on a stand 5 which is pivotally and slidably secured to the partition 2 at a point A. The stand has two other support points constituted by hinges B and C.

These points B and C are connected by two parallel arms 6 and 7 of equal length that are situated at different heights to two hinge points D and E situated on a stationary framework 8.

The points D and E and the points B and C are situated on respective common verticals, with the points B and E being at substantially the same height, as are the points C and D.

If the wall 2 expands by being heated, point A becomes A′, point B becomes B′, and point C becomes C′. Since the quadrilateral BCDE is a parallelogram, segment B′C′ remains parallel to BC, such that the stand 5 moves downwards while remaining parallel to itself and through a distance that is imposed by the displacement of A to A′.

The manifold 1 is preferably mounted to slide horizontally on the support 5.

Figure 2:
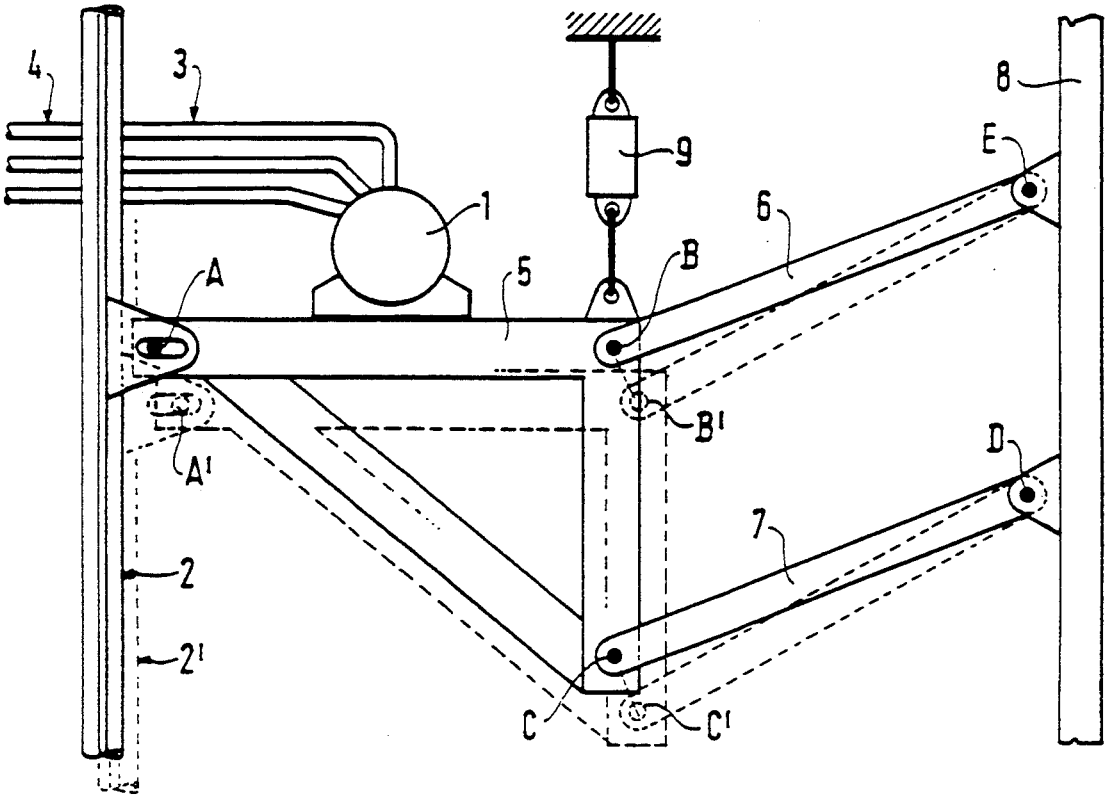
FIG. 2 is an elevation view of a second device of the invention in which the two arms are at a considerable angle to the horizontal, the device also including a constant support.

FIG. 2 shows a support device in which the arms 6 and 7 slope relative to the horizontal at an angle $\alpha$, such that horizontal displacement of the points B and C is considerably greater than in the embodiment of FIG. 1 since said points are constrained to describe circles of respective radii EB and DC. By an appropriate choice of the angle $\alpha$, is it thus possible to obtain horizontal displacement of the points B and C that is close to the horizontal displacement of the wall 2.

This makes it possible to limit sliding between the stand 5 and the wall 2 at the connection A.

In addition, the stand 5 is fixed to a constant support element 9 that makes use of springs, thereby making it possible to dimension the arm system for supporting only a fraction of the total load, thereby reducing the vertical load that is transmitted to the partition 2 made up of the boiler tubes.

It may be observed that in all the above variants, the hinge arms are subjected to no bending stress, but only to stresses in traction or compression, thereby making it possible for their right cross-sections to be considerably smaller than those of the arms in known devices which operate in bending.

The invention is particularly applicable to suspending a collector manifold on the wall of the combustion chamber in a steam generator or boiler, but it could also be applied to suspending other apparatuses, such as burners.

We claim:

1. A support device for supporting on a stationary framework a mass which is cantilevered-out from a moving element, said device comprising: a rigid stand supporting said mass and connected to the stationary framework via two parallel arms of equal length and situated at two different heights, each of the two parallel arms being hinged at one of one end thereof to a corresponding point on the stand and at another end thereof to a corresponding point on the stationary framework, and the rigid stand being placed on the moving element via a connection that slides horizontally.

2. A support device according to claim 1, wherein the mass is slidably placed on the rigid stand.

3. A support device according to claim 1, wherein the two parallel arms are inclined at an angle such that the horizontal displacement of said hinge points of said arms on the stand is close to the horizontal displacement of the moving element.

4. A support device according to claim 1, further including a spring support connected to said stand and exerting an upwards traction force on the stand.

* * * * *